US005533535A

United States Patent [19]

Lin et al.

[11] Patent Number: 5,533,535

[45] Date of Patent: Jul. 9, 1996

[54] POCKETABLE FOLDING UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 439,509

[22] Filed: May 11, 1995

[51] Int. Cl.[6] ..... A45B 11/00

[52] U.S. Cl. ..... 135/20.1; 135/25.1; 135/28; 135/25.4

[58] Field of Search ..... 135/20.1, 20.3, 135/25.1, 28, 41, 25.4, 33.2

[56] References Cited

U.S. PATENT DOCUMENTS 1,208,097 12/1916 Collins et al. ..... 135/20.1 X
3,837,352 9/1974 Weber ..... 135/20.1 X
4,474,201 10/1984 Kida ..... 135/20.1 X
5,355,903 10/1994 Haddad et al. ..... 135/20.1

*Primary Examiner*—Lanna Mai

[57] ABSTRACT

A pocketable folding umbrella includes a slim upper notch generally rectangular shaped and secured on an upper portion of a central shaft; a slim lower runner generally rectangular shaped and slidably held on the central shaft; a plurality of extremity rib sets radially pivotally secured to two extremity portions of the upper notch and the lower runner, a plurality of flat-side rib sets universally pivotally secured to two flat-side portions of the upper notch and the lower runner, and an umbrella cloth secured with the rib sets, whereby upon folding of an opened umbrella, the flat-side rib sets will be inwardly folded towards a flat side portion of the upper notch and the lower runner as accompanied with a radially folding of the extremity rib sets on the two extremity portions of the upper notch and the lower runner for greatly minimizing the volume of the folded umbrella for a convenient carrying and storage.

5 Claims, 5 Drawing Sheets

POCKETABLE FOLDING UMBRELLA

BACKGROUND OF THE INVENTION

A conventional folding umbrella as shown in FIG. 1 includes: eight sets of rib means 2 pivotally connected to a ferrule F of a lower runner N slidably held on the central shaft 1, and an umbrella cloth C secured with the eight sets of rib means 2. Since all the rib means 2 should be homogeneously distributed on the umbrella cloth c, the umbrella after being folded with still occupy a great volume P, which will be inconveniently carried or stored, especially not suitable to be stored in a pocket or in a handbag.

SUMMARY OF THE INVENTION

The object of the present invention is to provide a pocketable folding umbrella including a slim upper notch generally rectangular shaped and secured on an upper portion of a central shaft; a slim lower runner generally rectangular shaped and slidably held on the central shaft; a plurality of extremity rib sets respectively radially pivotally secured to two extremity portions of the upper notch and the lower runner, a plurality of flat-side rib sets respectively universally pivotally secured to two flat-side portions of the upper notch and the lower runner, and an umbrella cloth secured with rib sets, whereby upon folding of the umbrella from an opened state, the flat-side rib sets will be inwardly folded from an outer biased position towards a flat side portion of the upper notch and the lower runner as accompanied with a radially folding of the extremity rib sets on the two extremity portions of the upper notch and the lower runner for greatly minimizing the volume of the folded umbrella for a convenient carrying and storage when stored in a pocket or a handbag.

DETAILED DESCRIPTION

Figure 11:
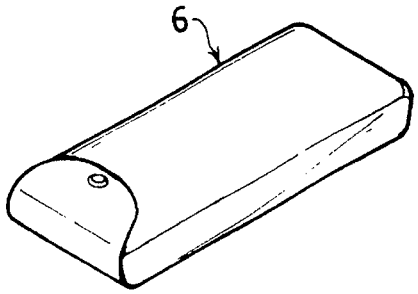
FIG. 11 is an illustration showing a folded umbrella in a packaging of the present invention.

As shown in FIGS. 2–12, the present invention comprises: a telescopic central shaft 1 having a grip 12 formed on a lower portion of the shaft 1; a rib assembly consisting of a plurality of extremity rib means 2 and a plurality of flat-side rib means 2*a*; a slim upper notch 3 secured on an upper portion 11 of the central shaft 1; a slim lower runner 4 slidably held on the central shaft 1 and positioned below the upper notch 3; an umbrella cloth 5 secured on the rib means 2, 2*a* and divided into a plurality of sectors 50 each sector 50 radially secured with two neighboring rib means (2, 2; 2, 2*a*; 2*a*, 2*a*) with joints 51; and a packaging 6 for storing a folded umbrella of the present invention as shown in FIG. 11.

Each extremity rib means 2 includes: at least a top rib 21 having an inner end portion 211 of the top rib 21 radially pivotally secured to a pivoting means 33 formed at each extremity portion E of the upper notch 3, and at least a stretcher rib 22 having an inner end portion 221 of the stretcher rib 22 radially pivotally secured to a pivoting means 33 formed at each extremity E of the lower runner 4 with the stretcher rib 22 pivotally connected with the top rib 21. Other ribs may be pivotally connected with the top rib 21 and the stretcher rib 22 as shown in the figures, not limited in this invention.

Each flat-side rib means 2*a* includes: at least a top rib 21 having an inner end portion 211 of the top rib 21 universally pivotally secured to a biasing means 34 formed on a flat side portion S of the upper notch 3, and at least a stretcher rib 22 having an inner end portion 221 of the stretch rib 22 universally pivotally secured to a biasing means 44 formed on a flat side portion S of the lower runner 4 with the stretcher rib 22 pivotally connected with the top rib 21. Other ribs may be further provided for pivotally connecting the top rib 21 and the stretcher rib 22.

The number of folds of the folding umbrella of the present invention are not limited. The mechanism of the biasing means 34, 44; and the shapes of the upper notch 33 and the lower runner 4 are also not limited in this invention.

Figure 1:
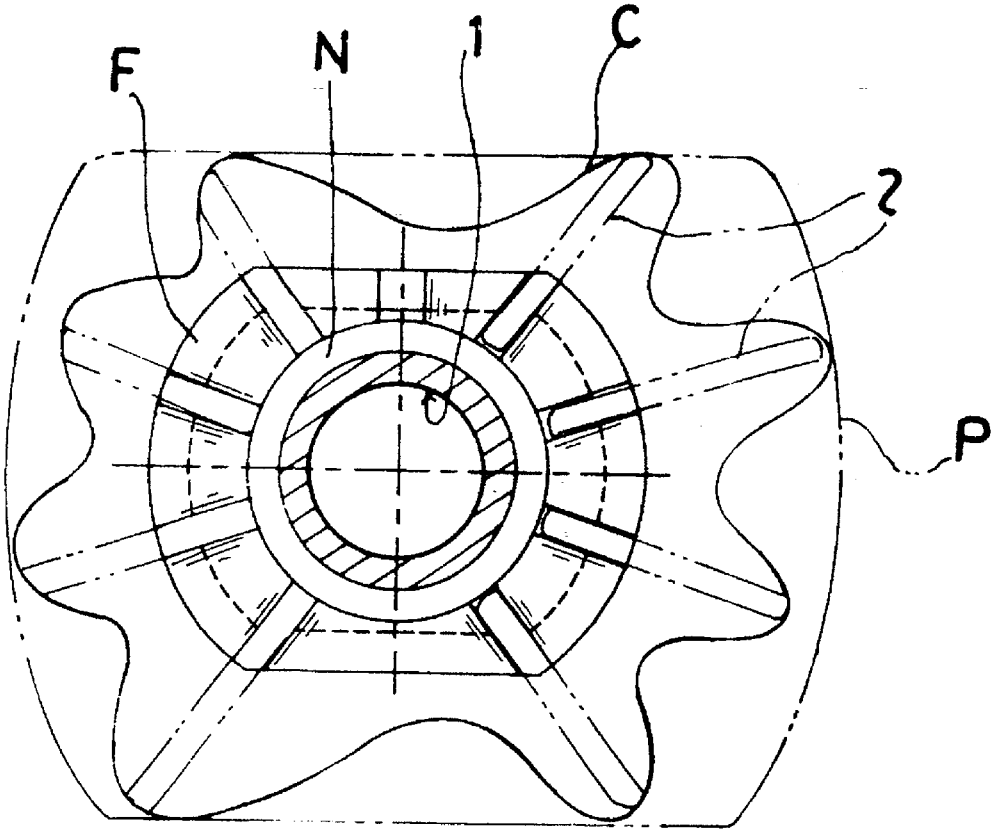
FIG. 1 is a partial cross sectional drawing of a conventional folding umbrella especially at a lower runner.
Figure 2:
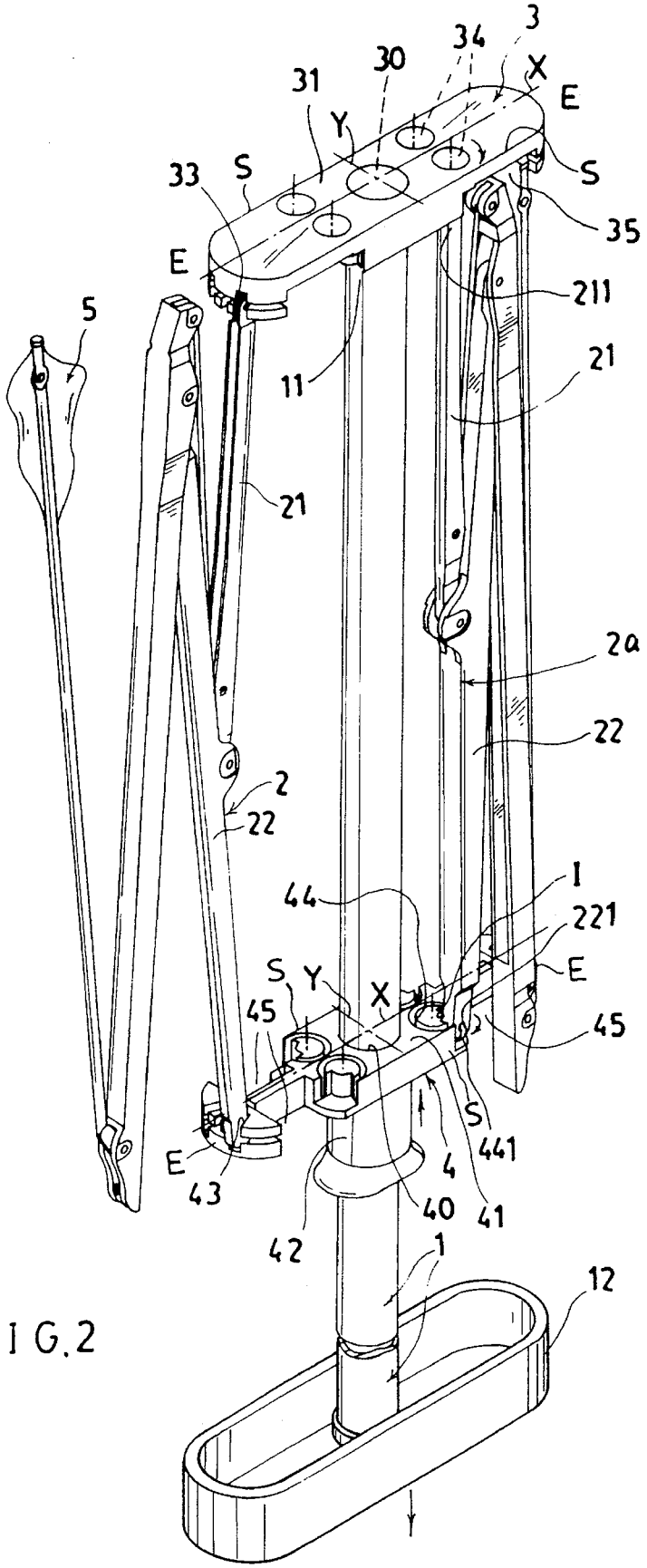
FIG. 2 is a perspective view of the present invention showing an umbrella initiated for opening from a folded state.
Figure 5:
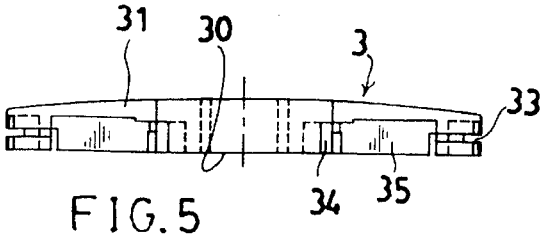
FIG. 5 is a front view of the upper notch as shown in FIG. 4.
Figure 6:
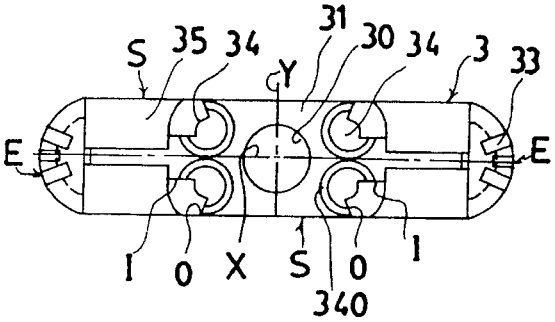
FIG. 6 is a bottom view of the upper notch when viewed from FIG. 4.
Figure 4:
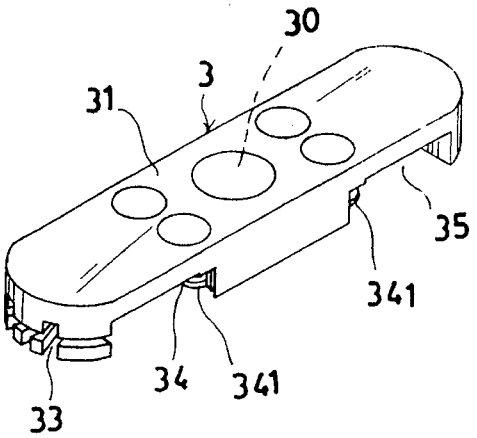
FIG. 4 is a perspective view of the upper notch of the present invention.

The slim upper notch 3 as shown in FIGS. 4–6 includes: an upper slim plate 31 generally rectangular or elliptic shaped defining a long axis X between two extremity portions E disposed on two opposite ends of the slim plate 31 and a short axis Y between two flat side portions S of the slim plate 31 and perpendicular to the long axis X, a central recess 30 recessed in a central portion of the slim plate 31 engaged with an upper portion 11 of the central shaft 1 for securing the upper notch 3 on the upper portion 11 of the central shaft 1, a plurality of pivoting means 33 formed on two opposite extremity portions E of the slim plate 31 for radially pivotally securing a plurality of top ribs 21 of the extremity rib means 2, a plurality of biasing means 34 formed on two opposite flat side portions S of the slim plate 31 and disposed around the central recess 30 for universally pivotally securing a plurality of top ribs 21 of the flat-side rib means 2*a*, and a plurality of cavities 35 recessed in the flat side portions S of the slim plate 31 each cavity 35 adjacent to each biasing means 34 for storing each flat-side rib means 2*a* after being folded as shown in FIG. 2.

Each biasing means 34 is formed with an inside retarding portion I contiguous to an inside surface of each cavity 35 recessed in the slim plate 31 and generally parallel to the long axis X for resting an inner portion of a top rib 21 of a folded flat-side rib means 2*a*, and an outside retarding portion O deviating from the inside retarding portion I with an acute angle and contiguous to the flat side portion S of the slim plate 31 for stopping the inner portion of the top rib 21 of an opened flat-side rib means 2*a*.

Figure 3:
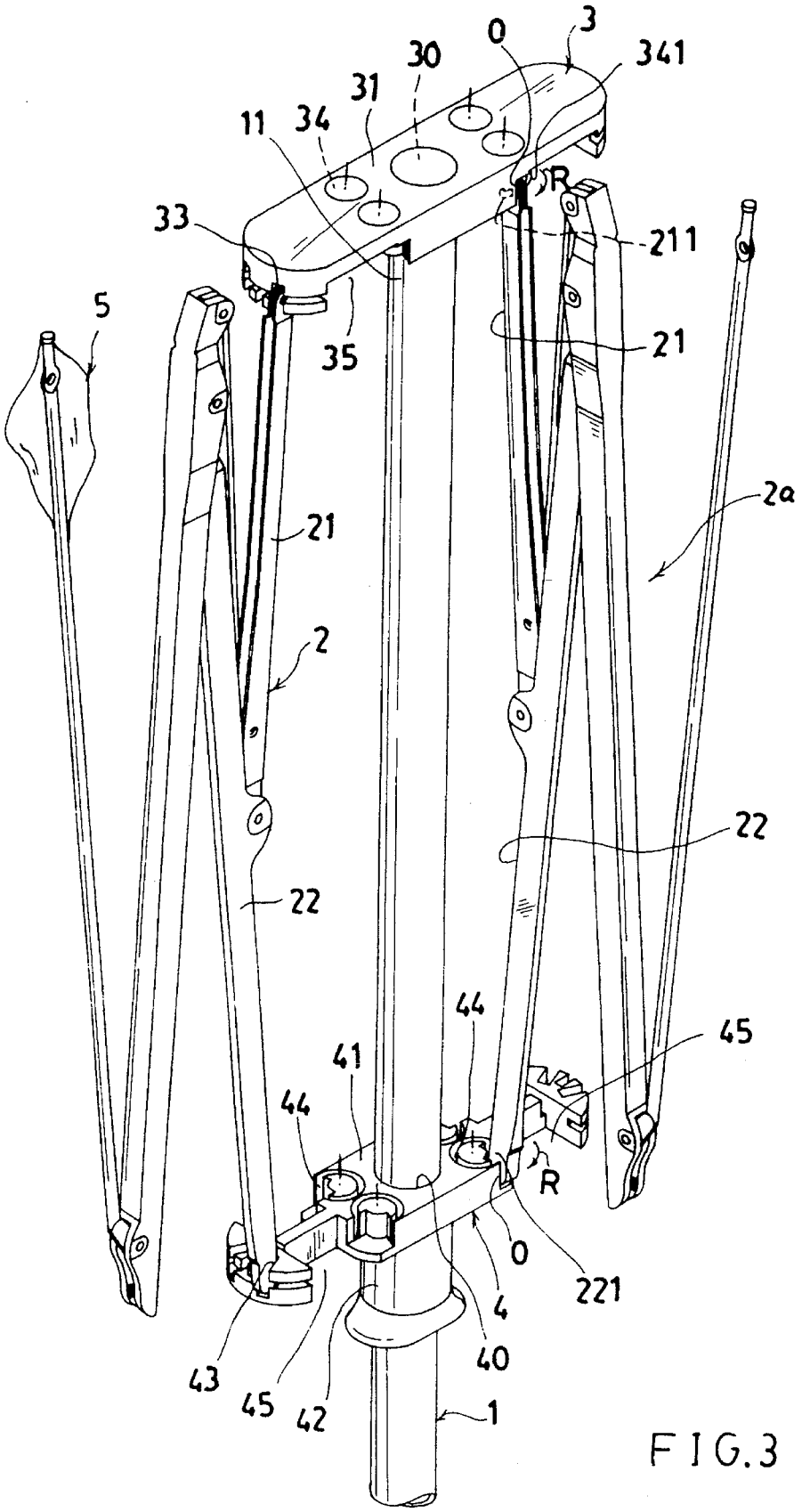
FIG. 3 is a perspective view of an opening umbrella continued from FIG. 2.

The biasing means 34 includes: a pivoting ring 341 embedded in the slim plate 31 for annularly slidably engaging a ring hole formed in the inner end portion 211 of the top rib 21 for circularly guiding the top rib 21 outwardly in direction R as shown in FIG. 3 when opening the umbrella as pulled by the extremity rib means 2 and the umbrella cloth 5, and also for circularly guiding the top rib 21 inwardly for retracting the rib means 2*a* when folding the umbrella for storing the rib means 2*a* in each cavity 35 of the upper notch 3.

Figure 9:
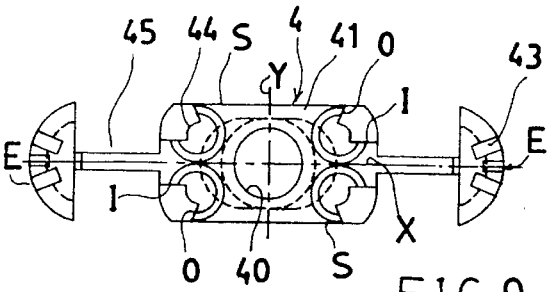
FIG. 9 is a top view of the lower runner when viewed from FIG. 7.
Figure 8:
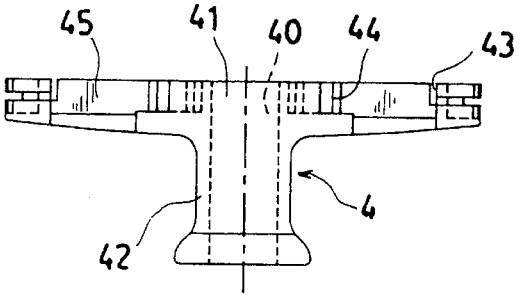
FIG. 8 is a front view of the lower runner when viewed from FIG. 7.
Figure 7:
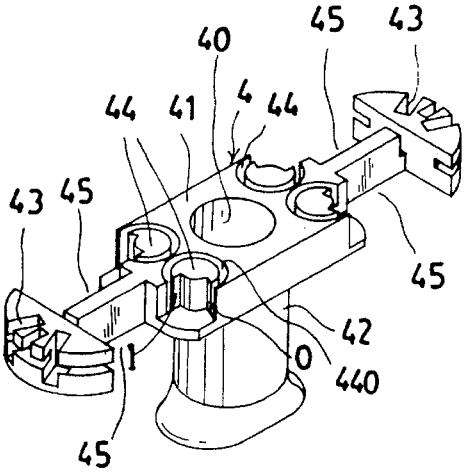
FIG. 7 is a perspective view of the lower runner of the present invention.
Figure 10:
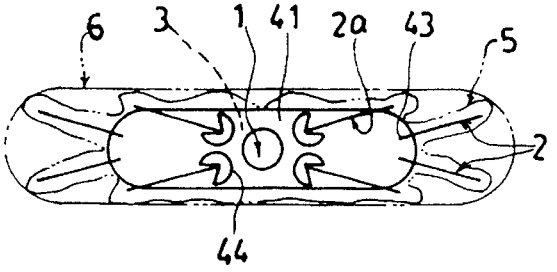
FIG. 10 is a cross sectional illustration of the present invention when folded.

The slim lower runner 4 as shown in FIGS. 7–9 includes: a lower slim plate 41 generally rectangular or elliptic shaped defining a long axis X between two extremity portions E disposed on two opposite ends of the lower slim plate 41 and a short axis Y between two flat side portions S of the lower slim plate 41 and perpendicular to the long axis X, a sleeve portion 42 perpendicularly secured with the slim plate 41 having a central hole 40 formed through the sleeve portion 42 slidably held on the central shaft 1, a plurality of pivoting means 43 formed on two opposite extremity portions E of the lower slim plate 41 for radially pivotally securing a plurality of stretcher ribs 22 of the extremity rib means 2, a plurality of biasing means 44 formed on two opposite flat side portions S of the lower slim plate 41 and disposed around the central hole 40 for universally pivotally securing a plurality of stretcher ribs 22 of the flat-side rib means 2*a*, and a plurality of cutouts 45 notched in the lower flat side portions S of the slim plate 41 each cutout 45 adjacent to each biasing means 44 for storing each flat-side rib means 2*a* after being folded as shown in FIG. 2.

Each biasing means 44 of the lower runner 4 is formed with an inside retarding portion I contiguous to an inside surface of each cutout 45 notched in the lower slim plate 41 and generally parallel to the long axis X for resting an inner portion of a stretcher rib 22 of a folded flat-side rib means 2*a*, and an outside retarding portion O deviating from the inside retarding portion I with an acute angle and contiguous to the flat side portion S of the lower slim plate 41 for stopping the inner portion of the stretcher rib 22 of an opened flat-side rib means 2*a*.

Figure 12:
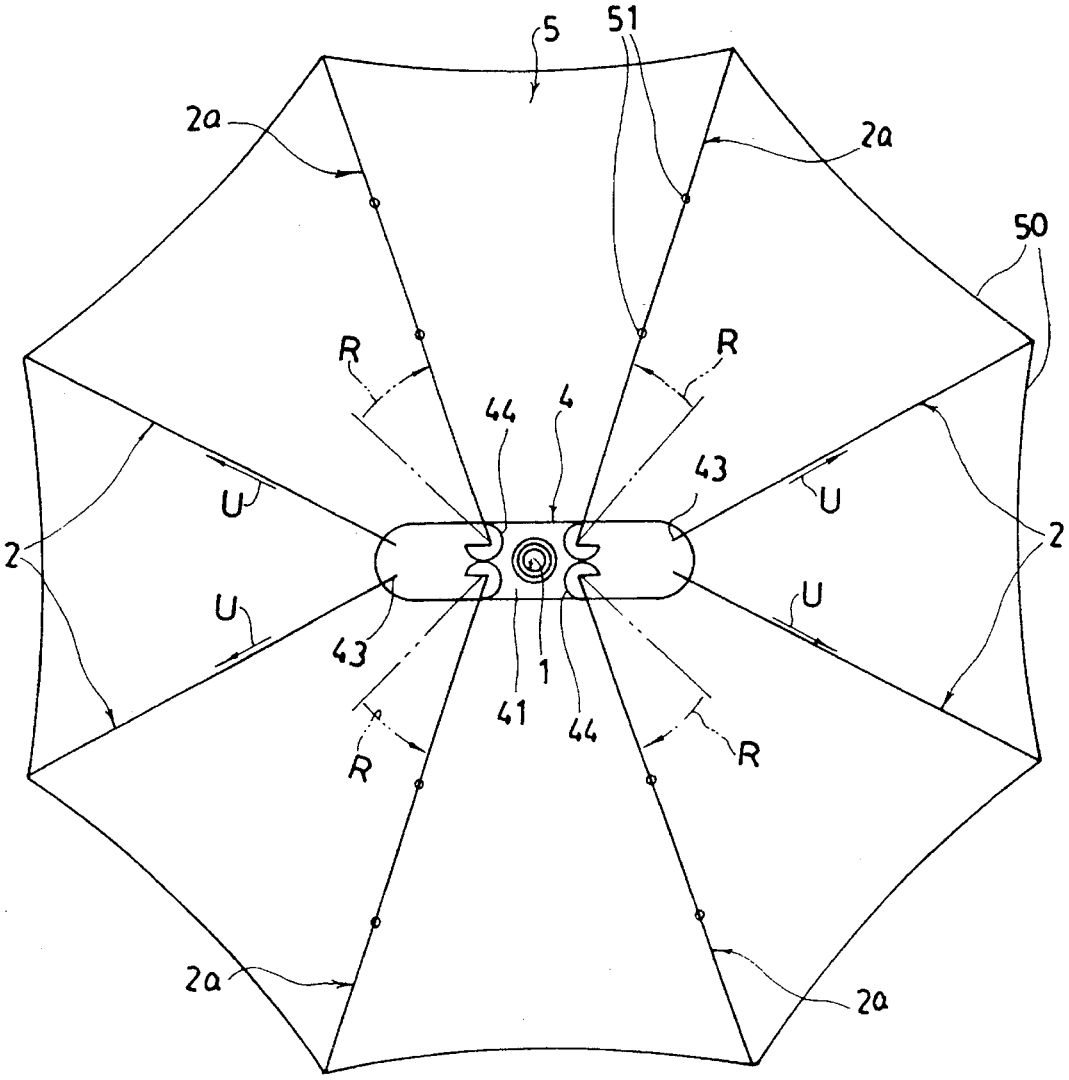
FIG. 12 is a bottom view of an opened umbrella of the present invention.

The biasing means 44 of the lower runner 4 includes: a pivoting ring 441 embedded in the lower slim plate 41 for annularly slidably engaging a ring hole formed in the inner end portion 221 of the stretcher rib 22 for circularly guiding the stretcher rib 22 outwardly in direction R as shown in FIG. 3 and 12 when opening the umbrella as pulled by the extremity rib means 2 and the umbrella cloth 5, and also for circularly guiding the stretcher rib 22 inwardly for retracting the rib means 2*a* when folding the umbrella for storing the rib means 2*a* in each cutout 45 of the lower runner 4.

All the pivoting rings 341, 441 may be embedded in the ring holes 340, 440 formed in the biasing means 34, 44.

Other modifications may be made for the biasing means in accordance with the present invention for pivotally connecting the top rib 21 and the stretcher rib 22 to the flat side portions S of the upper notch 3 and the lower runner 4 for universally or circularly biasing the top rib 21 and the stretcher rib 22 outwardly (R) when opening the umbrella as shown in FIGS. 3 and 12.

When opening the umbrella of the present invention from a closed state, one hand of the user may lower the grip 12 while his another hand may raise the lower runner 4 to radially unfold the extremity rib means 2 and to open the umbrella cloth 5. Since the flat-side rib means 2*a* and the extremity rib means 2 (which may be eight rib means 2, 2*a* as shown in FIG. 12) are generally homogeneously distributed on the umbrella cloth 5 by joints 51 to form a plurality of sectors 50, the opening umbrella cloth 5 as upwardly radially pulled (U) by the extremity rib means 2 will be tensioned so as to simultaneously bias all the flat-side rib means 2*a* in direction R and unfold the flat-side rib means 2*a* upwardly radially as universally or circularly biased by the biasing means 44, 34 on the lower runner 4 and the upper notch 3 for stably opening the umbrella as shown in FIG. 12.

Upon folding of the umbrella from its opened state, the extremity rib means 2 will be radially folded and the flat-side rib means 2*a* will be folded into the cavities 35 and the cutouts 45 formed in the side portions of the upper notch 3 and the lower runner 4 to greatly minimize a folding volume for a convenient handling and storage especially for an easy storage in a handbag or jacket pocket.

We claim:

1. A folding umbrella comprising:

a telescopic central shaft (1);

a slim upper notch (3) formed as a generally rectangular shape defining two opposite extremity portions on a long axis (X) and two opposite flat-side portions on a short axis (Y) perpendicular to the long axis (X), and secured on an upper portion of said central shaft (1);

a slim lower runner (4) formed as a generally rectangular shape defining two opposite extremity portions on a long axis (X) and two opposite flat-side portions on a short axis (Y) perpendicular to the long axis (X), and slidably held on said central shaft (1);

a plurality of extremity rib means (2) disposed on two opposite extremity portions of said upper notch (3) and said lower runner (4), each said extremity rib means (2) having at least a top rib (21) and a stretcher rib (22) pivotally connected with said top rib (21), said top rib (21) and stretcher rib (22) radially pivotally secured to said upper notch (3) and said lower runner (4);

a plurality of flat-side rib means (2*a*) disposed on two opposite flat side portions of said upper notch (3) and said lower runner (4), each said flat-side rib means (2*a*) having at least a top rib (21) and a stretcher rib (22) pivotally connected with said top rib (21), said top rib (21) and said stretcher rib (22) on said flat-side rib means (2*a*) universally pivotally secured to each said flat-side portion of said upper notch (3) and said lower runner (4); and an umbrella cloth (5) radially secured with said plurality of extremity rib means (2) and said flat-side rib means (2*a*) on said cloth (5) having a plurality of sectors (50) divided on said cloth (5) with each said sector (50) defined between every two neighboring rib means (2, 2*a*);

whereby upon unfolding of said rib means (2, 2*a*) of the umbrella, said extremity rib means (2) is radially extended for pulling said umbrella cloth (5) and said flat-side rib means (2*a*) for outwardly biasing said flat-side rib means (2*a*) for opening the umbrella; and upon folding of the rib means (2, 2*a*), said flat-side rib means (2*a*) is retracted to each said flat side portion of said upper notch (3) and said lower runner (4) for minimizing a folding volume;

said slim upper notch (3) including: an upper slim plate (31) generally rectangular shaped defining said long axis (X) between two extremity portions (E) disposed on two opposite ends of the slim plate (31) and said short axis (Y) between two flat side portions (S) of the slim plate (31) and perpendicular to the long axis (X), a central recess (30) recessed in a central portion of the slim plate (31) engaged on an upper portion (11) of the central shaft (1) for securing the upper notch (3) on the upper portion (11) of the central shaft (1), a plurality of pivoting means (33) formed on two opposite extremity portions (E) of the slim plate (31) for radially pivotally securing a plurality of said top ribs (21) of the extremity rib means (2), a plurality of biasing means (34) formed on two opposite flat side portions (S) of the slim plate (31) and disposed around the central recess (30) for universally pivotally securing a plurality of said top ribs (21) of the flat-side rib means (2*a*), and a plurality of cavities (35) recessed in the flat side portions (S) of the slim plate (31) each said cavity (35) adjacent to each said biasing means (34) for storing each said flat-side rib means (2*a*) after being folded; and said slim lower runner (4) including: a lower slim plate (41) generally rectangular shaped defining said long axis (X) between two extremity portions (E) disposed on two opposite ends of the lower slim plate (41) and said short axis (Y) between two flat side portions (S) of the lower slim plate (41) and perpendicular to the long axis (X), a sleeve portion (42) perpendicularly secured with the slim plate (41) having a central hole (40) formed through the sleeve portion (42) slidably held on the central shaft (1), a plurality of pivoting means (43) formed on two opposite extremity portions (E) of the lower slim plate (41) for radially pivotally securing a plurality of said stretcher ribs (22) of the extremity rib means (2), a plurality of biasing means (44) formed on two opposite flat side portions (S) of the lower slim plate (41) and disposed around the central hole (40) for universally pivotally securing a plurality of said stretcher ribs (22) of the flat-side rib means (2*a*), and a plurality of cutouts (45) notched in the lower flat side portions (S) of the slim plate (41) each said cutout (45) adjacent to each said biasing means (44) for storing each said flat-side rib means (2*a*) after being folded.

2. A folding umbrella according to claim 1, wherein each said biasing means (34) of said upper notch (3) is formed with an inside retarding portion (I) contiguous to an inside surface of each said cavity (35) recessed in the slim plate (31) and generally parallel to the long axis (X) for resting an inner portion of said top rib (21) of a folded flat-side rib means (2*a*), and an outside retarding portion (O) deviating from the inside retarding portion (I) with an acute angle and contiguous to the flat side portion (S) of the slim plate (31) for stopping the inner portion of the top rib (21) of an opened flat-side rib means (2*a*).

3. A folding umbrella according to claim 1, wherein said biasing means (34) of said upper notch (3) includes:

a pivoting ring (341) embedded in the slim plate (31) for annularly slidably engaging a ring hole formed in the inner end portion (211) of the top rib (21) for circularly guiding the top rib (21) outwardly when opening the umbrella as pulled by the extremity rib means (2) and the umbrella cloth (5), and for circularly guiding the top rib (21) inwardly for retracting the rib means (2*a*) when folding the umbrella for storing the rib means (2*a*) in each said cavity (35) of the upper notch (3).

4. A folding umbrella according to claim 1, wherein each said biasing means (44) of the lower runner (4) is formed with an inside retarding portion (I) contiguous to an inside surface of each said cutout (45) notched in the lower slim plate (41) and generally parallel to the long axis (X) for resting an inner portion of a stretcher rib (22) of a folded flat-side rib means (2*a*), and an outside retarding portion (O) deviating from the inside retarding portion (I) with an acute angle and contiguous to the flat side portion (S) of the lower slim plate (41) for stopping the inner portion of the stretcher rib (22) of an opened flat-side rib means (2*a*).

5. A folding umbrella according to claim 1, wherein said biasing means (44) of the lower runner (4) includes:

a pivoting ring (441) embedded in the lower slim plate (41) for annularly slidably engaging a ring hole formed in the inner end portion (221) of the stretcher rib (22) for circularly guiding the stretcher rib (22) outwardly when opening the umbrella as pulled by the extremity rib means (2) and the umbrella cloth (5), and for circularly guiding the stretcher rib (22) inwardly for retracting the rib means (2*a*) when folding the umbrella for storing the rib means (2*a*) in each said cutout (45) of said lower runner (4).

* * * * *